US006644801B2

(12) United States Patent
Matsui et al.

(10) Patent No.: US 6,644,801 B2
(45) Date of Patent: Nov. 11, 2003

(54) INK JET RECORDING APPARATUS

(75) Inventors: Shinya Matsui, Tokyo (JP); Akira Kida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 365 days.

(21) Appl. No.: 09/748,223

(22) Filed: Dec. 27, 2000

(65) Prior Publication Data

US 2001/0005465 A1 Jun. 28, 2001

(30) Foreign Application Priority Data

Dec. 27, 1999 (JP) ..... 11-369471

(51) Int. Cl.[7] ..... B41J 2/01
(52) U.S. Cl. ..... 347/104; 400/642; 400/645
(58) Field of Search ..... 347/104; 400/625, 400/636.1, 636.2, 636.3, 637, 637.1, 637.2–637.6, 645, 638, 639, 639.1, 639.2, 640, 641, 620, 645.3, 645.4, 645.5, 646, 654, 656

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,683,188 A | * | 11/1997 | Miyazaki et al. | 400/279 |
| 5,847,719 A | | 12/1998 | Yamaguchi et al. | |

FOREIGN PATENT DOCUMENTS

| | | | |
|---|---|---|---|
| JP | 54-56847 | | 5/1979 |
| JP | 59-123670 | | 7/1984 |
| JP | 60-71260 | | 4/1985 |
| JP | 10-226059 | * | 8/1998 |

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

An ink jet recording apparatus includes a transporting roller for transporting a recording sheet to a recording section of the apparatus; a pre-biasing roller disposed upstream of the transporting roller relative to the direction of transportation of the recording sheet and arranged to impart to the recording sheet such a tendency that both lateral end portions of the recording sheet are curled away from a recording head; and a platen having a guide surface for guiding and supporting the recording sheet. An aperture is formed in the platen so as to oppose the recording head and so as to extend in the width direction of the recording sheet. The aperture has a predetermined width and a sloping surface so as to extend downward in the direction of transportation of the recording sheet.

30 Claims, 9 Drawing Sheets

INK JET RECORDING APPARATUS

BACKGROUND OF THE INVENTION

1. Field of the Invention

The present invention relates to an ink jet recording apparatus which discharges ink onto a recording medium thereby recording information on the recording medium. More particularly, the present invention is concerned with an ink jet recording apparatus suitable for use in an information processing apparatus such as a printer, a copying machine, a wordprocessor, or a computer.

2. Description of the Related Art

Recording apparatuses have been known which function as a printer, a copying machine, or a facsimile machine. Recording apparatuses are also used as output devices for composite electronic devices such as a computer or a wordprocessor, as well as for a workstation. Such recording apparatuses are designed and configured to progressively record images including characters and symbols on recording media such as recording paper sheets or plastic sheets, in accordance with given image information. Such known recording apparatuses are classified according to the recording method relied upon: namely, ink-jet-type recording apparatuses, wire-dot-type recording apparatuses, thermal recording apparatuses, laser beam recording apparatuses and so on.

The recording apparatuses are also classified according to the direction of the recording. For instance, a serial-type recording apparatus performs recording while scanning across the recording medium in a main-scan direction that crosses the direction of a sub-scan effected by feeding the recording medium. A recording head moves along the recording medium in the main-scan direction so as to record a series of image portions. When the recording for a single line is finished, the recording medium is fed so as to effect a line-feed in the sub-scan direction by a predetermined pitch of the recording lines. The recording head then commences its movement again in the main-scan direction so as to perform the recording of a series of image portions along the next recording line. This operation is repeated until the recording is finished over a desired area on the recording medium.

In contrast, a line-type recording apparatus performing the recording employs only a sub-scan motion. In this type of recording apparatus, the recording medium is set at a predetermined recording position in the recording apparatus, and the recording of a series of image portions along one recording line is performed at one time while allowing one pitch feed of the recording medium to be performed between the recording operations along successive lines of recording, whereby an image is recorded over a desired area on the recording medium.

The aforementioned ink-jet-type recording apparatus (referred to as an "ink jet recording apparatus") performs recording by discharging ink onto the recording medium from the recording head. This type of recording apparatus is superior in that it can perform high-speed recording of highly intricate images by a simple structure of the recording head on ordinary plain paper sheets without necessitating any specific treatment of the paper sheets. In addition, this type of recording apparatus can operate with a reduced cost and at a low level of noise by virtue of its non-impact nature and, further, advantageously permits easy recording of multi-color images with the use of a multiplicity of types of ink of different colors.

Among various kinds of ink jet recording apparatuses, an ink jet recording apparatus of the type which discharges ink by using thermal energy offers an advantage in that a recording head having liquid channels, i.e., liquid discharge nozzle openings, arranged at a high density, can easily be produced. More specifically, such a recording head can be produced by depositing various components such as electrothermal transducers, electrodes, liquid channel walls, and a top plate on a substrate, by using a semiconductor process including steps such as etching, evaporation, and sputtering. This leads to a more compact structure of the recording head and, hence, of the recording apparatus. Furthermore, elongation and two-dimensional development of the recording head can easily be achieved by advantageously combining IC technologies and micro-machining techniques, enabling easy implementation of full-multi-nozzle recording heads and of high-density packaging of the recording heads.

In the meantime, a variety of demands or requirements are imposed on the materials of the recording media. Studies and attempts have been made to cope with such demands and, nowadays, recording apparatuses are available that perform recording on recording media other than conventionally used paper media (including thin paper sheets and processed paper), such as a thin plastic sheet, e.g., an OHP transparency, leather, non-woven fabric, and a metal sheet.

In general, an ink jet recording apparatus essentially requires that the distance between the recording medium such as a paper sheet and the recording head be maintained within a predetermined tolerance range. To this end, a guide plate known as a platen is used to back and support a recording paper sheet in a recording section of the apparatus. It is often experienced that the recording head discharges the ink in the absence of a recording paper sheet in the recording section, as in the case of the use of the wrong size of paper or sheet feed failure due to a jam. In such a case, the guide support surface of the platen is contaminated with the discharged ink.

Japanese Patent Laid-Open Publication No. 10-337886 discloses an art which is envisaged to eliminate this problem. Referring to FIG. 11, a known recording apparatus of the type disclosed in the above-mentioned patent publication incorporates an ink absorbent 93 arranged behind a plate member 91 that guides a recording paper sheet 90 in the recording section. An aperture 92 is formed in a portion of the plate member 91 opposing the recording head. The aperture 92 extends in the width direction of the recording paper sheet 90 over a length large enough to encompass both widthwise ends of the recording paper sheet 90. In operation, any ink discharged in the absence of the recording paper sheet 90 or directed to a region devoid of the paper sheet 90 is received by the ink absorbent 93 through the aperture 92.

This known recording apparatus still suffers from a problem in that a recording sheet transportation failure tends to be caused by undesirable curling of the recording sheet, particularly when an image is formed by a large number of ink dots deposited at high density in a region of the recording sheet so close to a leading or trailing edge thereof so as to scarcely leave a margin on the recording sheet. This tendency is particularly notable when the recording sheet is thick. In addition, different kinds of recording sheets exhibit different curling behaviors, and an identical recording sheet tends to change its curling direction over time.

SUMMARY OF THE INVENTION

Accordingly, it is an object of the present invention to provide an ink jet recording apparatus which allows an image that requires a large amount of ink ejection per unit area to be formed in a region of the recording medium which just falls within predetermined margins of the recording sheet.

It is another object of the present invention to provide a recording apparatus in which left and right end portions of a recording medium are curved away from the recording head, thereby enabling an image to be formed in a region which just falls within predetermined margins of the recording sheet.

It is still another object of the present invention to provide an ink jet recording apparatus having a recording head for discharging ink onto a recording medium thereby performing recording, comprising a transporting roller for transporting the recording medium into a recording section, and an enforcing member disposed upstream of the transporting roller as viewed in the direction of transportation and arranged to force the recording medium to curl into a shape suitable for recording.

It is a further object of the present invention to provide an ink jet recording apparatus having a recording head for discharging ink onto a recording medium thereby performing recording, comprising a transporting roller for transporting the recording medium into a recording section, and an enforcing member disposed upstream of the transporting roller as viewed in the direction of transportation and arranged to impart a tendency to the recording sheet such that both lateral ends of the recording sheet are biased away from the recording head.

To these ends, according to one aspect of the present invention, there is provided a recording apparatus having recording means for effecting recording on a recording medium at a recording zone, the recording apparatus comprising: a transporting roller for transporting the recording medium to the recording zone; and a pre-biasing member disposed upstream of the transporting roller and arranged to impart to the recording medium a curling tendency enabling recording to be performed.

In accordance with another aspect of the present invention, there is provided a recording apparatus having recording means for effecting recording on a recording medium at a recording zone, the recording apparatus comprising: a transporting roller for transporting the recording medium to the recording zone; and a pre-biasing member disposed upstream of the transporting roller relative to the direction of transportation of the recording medium and arranged to provide the recording medium with a tendency such that left and right end portions of the recording medium are biased away from the recording means.

In accordance with still another aspect of the present invention, there is provided a recording apparatus having recording means for effecting recording on a recording medium at a recording zone, the recording apparatus comprising: a transporting roller for transporting the recording medium to the recording zone; a pre-biasing member disposed upstream of the transporting roller relative to the direction of transportation of the recording medium and arranged to provide the recording medium with a tendency such that left and right end portions of the recording medium are biased away from the recording means; a platen having a guiding surface for guiding and supporting the recording medium in the recording section; an aperture formed in the platen and extending in the width direction of the recording medium and having a predetermined width, the aperture being disposed so as to oppose the recording means; and a sloping surface which is disposed in the aperture and extending downstream relative to the direction of transportation of the recording medium.

Preferably, the width of the aperture is smaller than the scanning stroke of the recording head.

The ink jet recording apparatus may further comprise an ink absorbent disposed so as to be exposed through the aperture.

Preferably, the recording head is configured to discharge at least one ink droplet produced by thermal energy, thereby performing recording.

According to yet another aspect of the present invention, a recording apparatus having recording means for effecting recording on a recording medium at a recording zone includes transporting means and pre-biasing means. The transporting means transports the recording medium to the recording zone. The pre-biasing means disposed upstream of the transporting means imparts to the recording medium a curling tendency enabling recording to be performed.

Further objects, features and advantages of the present invention will become apparent from the following description of the preferred embodiments with reference to the attached drawings.

DESCRIPTION OF THE PREFERRED EMBODIMENTS

The various embodiments of the present invention will be described with reference to the accompanying drawings.

<Description of First Embodiment>

Figure 1:
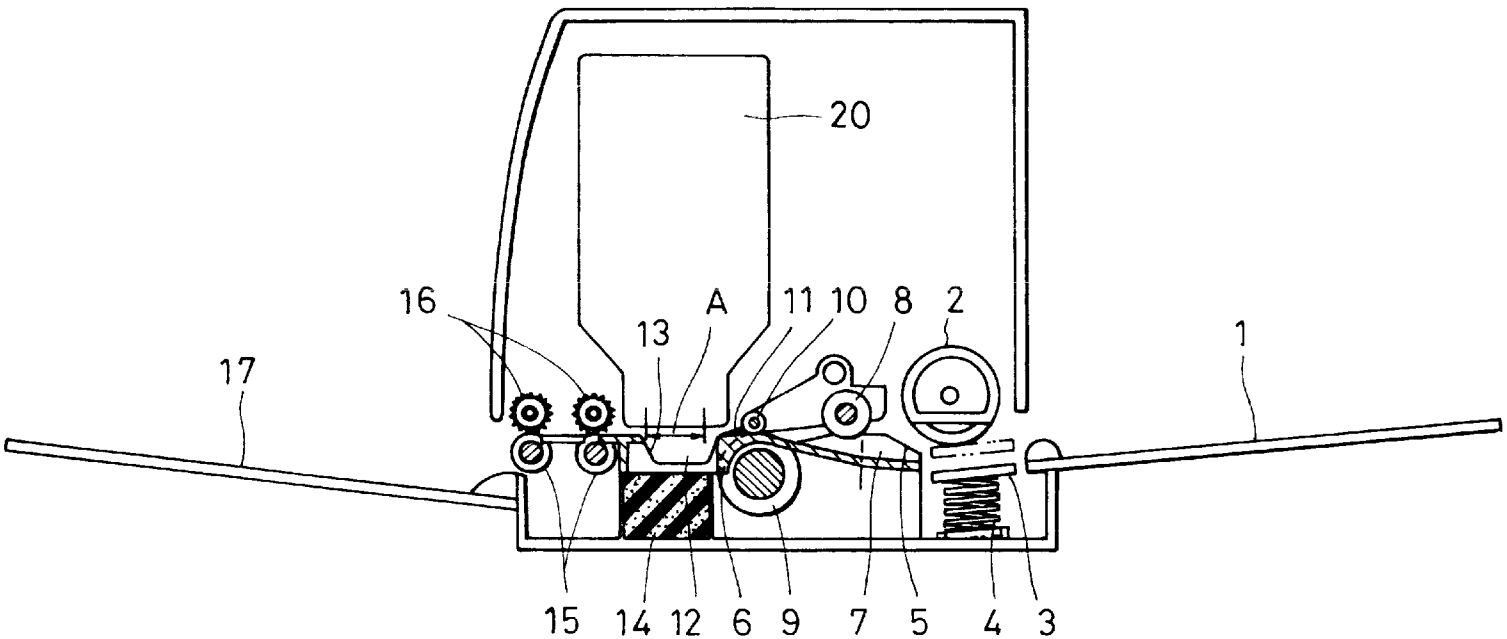
FIG. 1 is a schematic sectional view of a first embodiment of an ink jet recording apparatus in accordance with the present invention.

Referring to FIG. 1, which is a schematic sectional view of an ink jet recording apparatus in accordance with the present invention, the recording apparatus has a sheet feed tray 1 for carrying a stack of recording sheets, a sheet feed roller 2 for feeding the recording sheets one-by-one, a pressing plate 3 opposing the sheet feed roller 2, a pressing plate urging spring 4 for urging the pressing plate 3 against the sheet feeder roller 2, and a separator member 5 which serves to separate the topmost recording sheet from other sheets. The separator member may be a known member made of a plastic in the form of a rib or a member which presents a surface for separating the sheet, and may be covered partially or entirely by a non-woven fabric or a foam member.

The ink jet recording apparatus further has the following parts or components: a platen 6 which serves as a member for guiding and supporting the recording sheets which are fed successively; a first guide member 7 provided on the platen 6; a pre-biasing roller 8 serving as an enforcing device for imparting, for example, a curling tendency to both the left and right end portions of each recording sheet, i.e., to both lateral ends that are substantially perpendicular to the leading and trailing ends of the recording sheet; a transporting roller 9 for transporting the recording sheet into a recording section; a pinch roller 10 which follows the rotation of the transporting roller 9 to cooperate with the latter to transport the recording sheet; and a sheet pressing member 11 which serves to prevent the recording sheet from floating or rising above the platen.

The ink jet recording apparatus further has a recording head 20 which discharges ink onto the recording sheet, to thereby record information. Although not limited, the recording head 20 is designed and configured to perform color recording. Thus, the recording head 20 has nozzle arrays assigned to different kinds of ink of different colors: namely, black (K), cyan (C), magenta (M) and yellow (Y). Each nozzle array has an ink discharge region, i.e., a recording region, that extends over a length indicated by a double-headed arrow "A" in FIG. 1. The nozzle arrays are arranged side by side in the direction of the scan performed by the recording head.

Numeral 12 designates an aperture formed in a portion of the platen 6 opposing the recording region "A". Numeral 13 designates a plurality of second guide members (only one of the members is visible in FIG. 1) disposed within the aperture 12. An ink absorbent 14 disposed under the aperture 12 absorbs waste ink discharged from the recording head 20.

The ink jet recording apparatus further has sheet ejecting rollers 15 for ejecting the recording sheet, and spur wheels 16 that follow the rotation of the sheet ejecting rollers 15. Numeral 17 designates a sheet discharge tray for receiving the recording sheets ejected from the recording apparatus.

Figure 3:
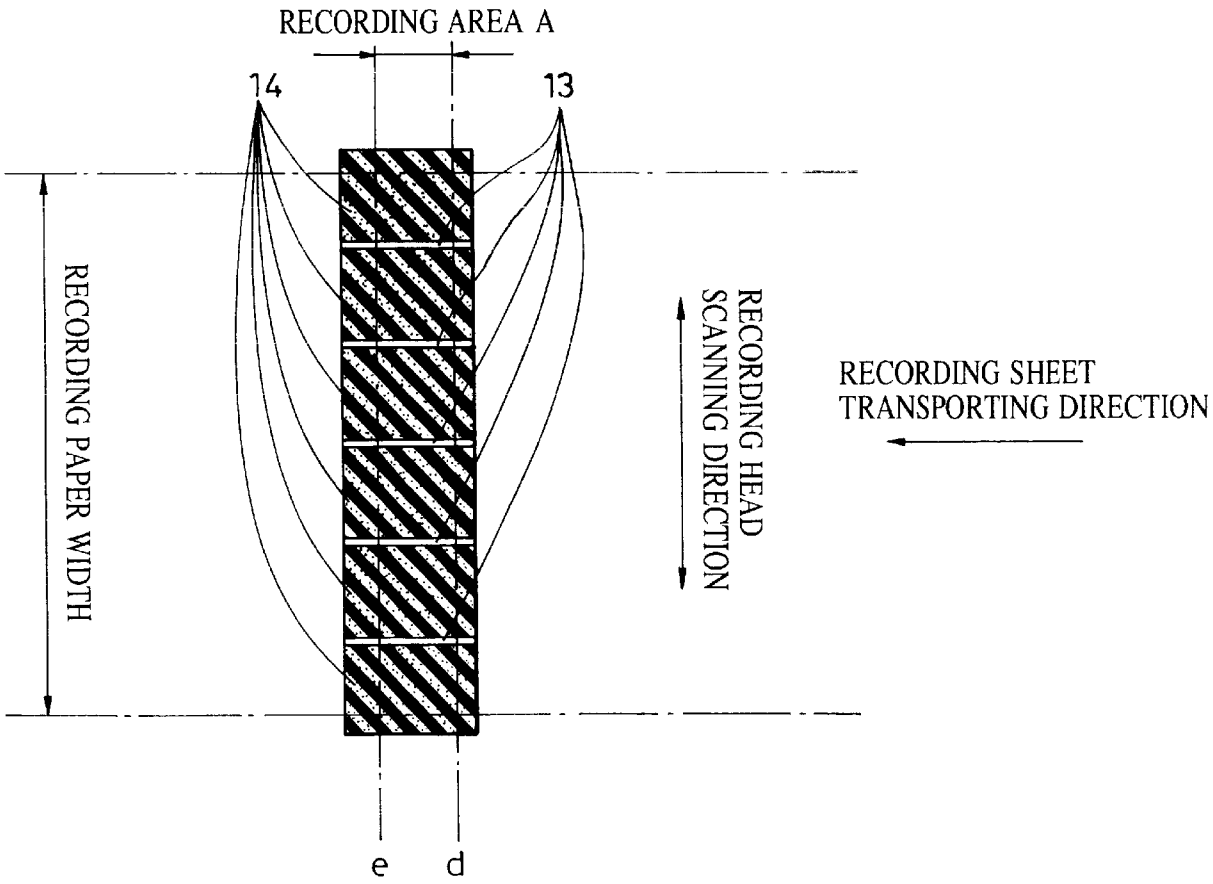
FIG. 3 is a fragmentary plan view of the ink jet recording apparatus of the first embodiment.

Referring now to FIG. 3 which is a fragmentary plan view of the ink jet recording apparatus, the second guide members 13 are disposed at positions spaced away from the path of the recording sheet. In order to prevent build-up of ink on the second guide members 13, each second guide member 13 has the form of a narrow strip of a width of about 0.5 mm to about 2.0 mm. The second guide members 13 are arranged side-by-side in the direction of the main scan performed by the recording head. Each second guide member 13 has an upward sloping surface at the downstream end thereof as viewed in the direction of transportation of the recording sheet. The ink absorbent 14 is exposed through the clearances between adjacent second guide members 13. The ink absorbent 14 has a span greater than the recording region "A" in the direction of transportation of the recording sheet.

In operation of the ink jet recording apparatus, a stack of the recording sheets is set on the sheet feeder tray 1. The pressing plate 3 is urged by the pressing plate urging spring 4 but is normally held at a lowered position as indicated by the solid lines in FIG. 1 by the effect of, for example, a cam. When the sheet feed roller 2 starts to rotate to commence the sheet feeding operation, the pressing plate 3 is released from the lowered position and presses the stack of recording sheets against the sheet feeder roller 2 by the force produced by the pressing plate urging spring 4. As the sheet feed roller 2 further rotates, the topmost recording sheet alone is separated by the separator member 5 and is transported into the recording section of the ink jet recording apparatus.

The recording sheet thus separated and transported into the recording section further advances while being guided at its reverse side by the first guide member 7, while both lateral end portions, i.e., the left and right end portions, of the recording sheet are forced by the pre-biasing roller 8 so as to have a curling tendency to curl downward as viewed in FIG. 1. The recording sheet is then nipped between the transporting roller 9 and the pinch roller 10. The recording sheet thus nipped between the pair of rollers then advances to the recording region "A" while being guided by the platen 6 and the sheet pressing member 11. The recording head 20 then performs the recording on the recording sheet that has arrived at the predetermined recording position. The recording sheet carrying the recorded information is nipped at its leading end by the sheet ejecting rollers 15 and the cooperating spur wheels 16, and is further moved and ejected onto the sheet discharge tray 17. Although the illustrated embodiment employs a pair of roller-spur wheel combinations arranged in tandem fashion for the purpose of ejecting the recording sheet, this is only illustrative and only one such combination may be used. It is also possible to use a suitable sheet guide for guiding the recording sheet which is being ejected.

Recording sheets tend to curl naturally subject to, for example, changes in environmental conditions. In general, however, the curling tendency is suppressed for sheets having basis weights less than 100 g/m$^2$, because such sheets exhibit stiffness just sufficient to cancel any curling tendency when the sheet is nipped between the transporting roller 9 and the pinch roller 10. However, thick sheets having basis weights of 100 g/m$^2$ or greater often remain curled even after passing through the nip between the transporting roller 9 and the pinch roller 10, which tends to hamper the recording operation. The state of curling of a recording paper sheet is roughly sorted into types that are shown in FIGS. 4 to 7 in an exaggerated manner.

Figure 4:
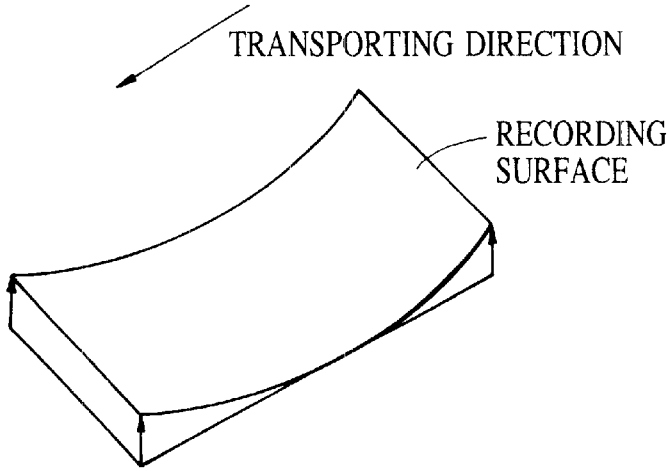
FIGS. 4 to 7 are illustrations of a recording sheet used in the first embodiment, showing different states of curling.

When a recording sheet curled as shown in FIG. 4 is nipped between the transporting roller 9 and the pinch roller 10 and advanced to the recording region "A", the leading end of the recording sheet tends to curl upward into contact with the recording head 20, posing a risk of folding of the leading end, as well as contamination or smearing of the recording sheet surface with the ink.

Figure 5:
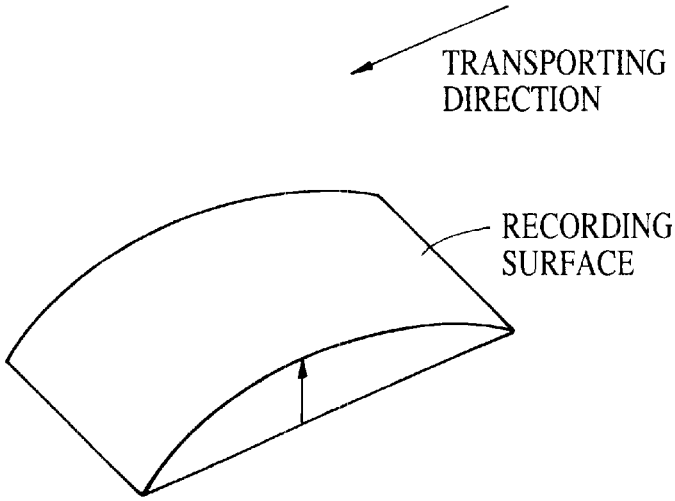

When a recording sheet curled as shown in FIG. 5 is nipped between the transporting roller 9 and the pinch roller 10 and advanced to the recording region "A", the leading end of the recording sheet tends to curl downward, failing to be caught in the nip between the sheet ejecting rollers 15 and the spur wheels 16, thus hampering the transportation. The downward curl may also cause the leading end of the sheet to be wrongly introduced into the aperture 12 formed in the platen 9. When an image formed of a large amount of ink per unit area is recorded, the recording medium tends to expand due to absorption of the ink. The ink, however, does not permeate to the reverse side of the recording sheet particularly when the sheet has a large thickness. This means that the reverse side of the recording sheet does not expand. Consequently, the recording sheet immediately after the ejection of ink curves such that the surface thereof carrying the recorded information is upwardly convex. This tendency will be promoted when an image formed by a large quantity of ink per unit area is recorded on a recording sheet that has been curled in the manner shown in FIG. 5, thus increasing the risk of sheet transportation failure.

Figure 6:
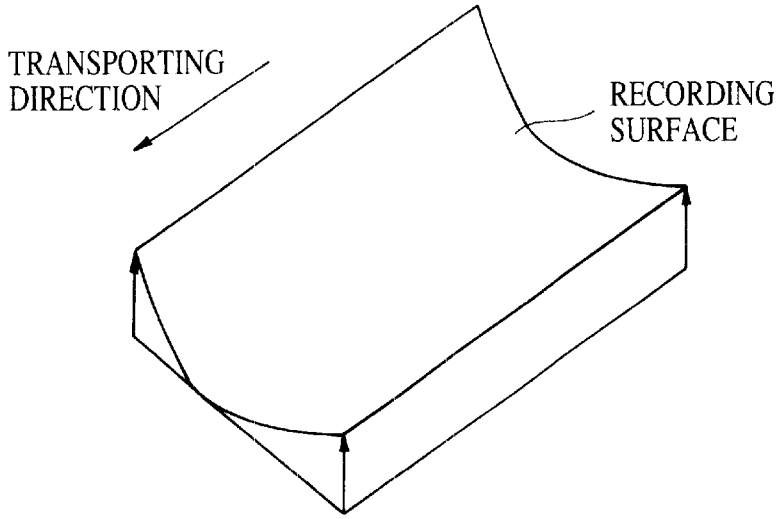

When a recording sheet curled as shown in FIG. 6 is nipped between the transporting roller 9 and the pinch roller 10 and advanced to the recording region "A", the left and right end portions of the recording sheet tend to float so that the recording surface becomes concave, although the amount of curl at the leading end is lessened to some extent.

This poses a risk of interference between both lateral ends of the recording sheet and the recording head 20, resulting in a folding of the recording sheet or contamination or smearing of the recording surface of the sheet with the ink.

Figure 7:
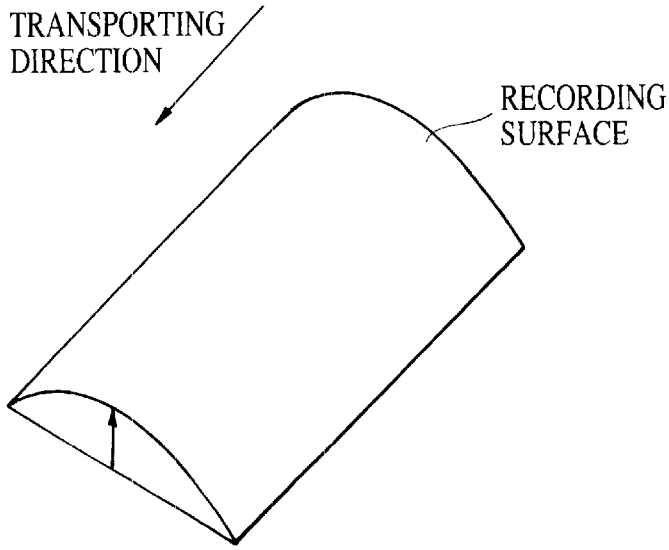

When a recording sheet curled as shown in FIG. 7 is nipped between the transporting roller 9 and the pinch roller 10 and advanced to the recording region "A", the curl at the leading end of the sheet is appreciably cancelled, while the left and right end portions of the sheet are slightly curved downward to make the sheet concave at the reverse side thereof. This recording sheet is free from the problems of interference with the recording head 20 and undesired introduction into the aperture 12 and, therefore, does not hamper the recording operation.

In the illustrated embodiment, a recording sheet which has a curling tendency as shown by any of FIGS. 4 to 6 is pre-biased into the state shown in FIG. 7 before the recording sheet is fed into the nip between the transporting roller 9 and the pinch roller 10. In order to pre-bias the recording sheet to the state shown in FIG. 7, the left and right end portions of the recording sheet are pressed and pre-biased to curl downwardly by the effect of the pre-biasing roller 8, while the remaining portion of the recording sheet is guided by the first guide member 7 provided on the platen 6 during advancement of the recording sheet. A thick recording sheet, once pre-biased into the state shown in FIG. 7, does not resume its original curling tendency such as that shown in FIG. 4, FIG. 5, or FIG. 6. It is therefore possible to control the curling behavior of the recording sheet during the recording. Any slight downward curl, which may appear at the leading end of the recording sheet after the recording, does not cause transportation failure, because the leading end of such a sheet moves forward and upward along the ascending sloping surfaces of the second guide members 13 into the nips between the sheet ejecting rollers 15 and the spur wheels 16.

Figure 2:
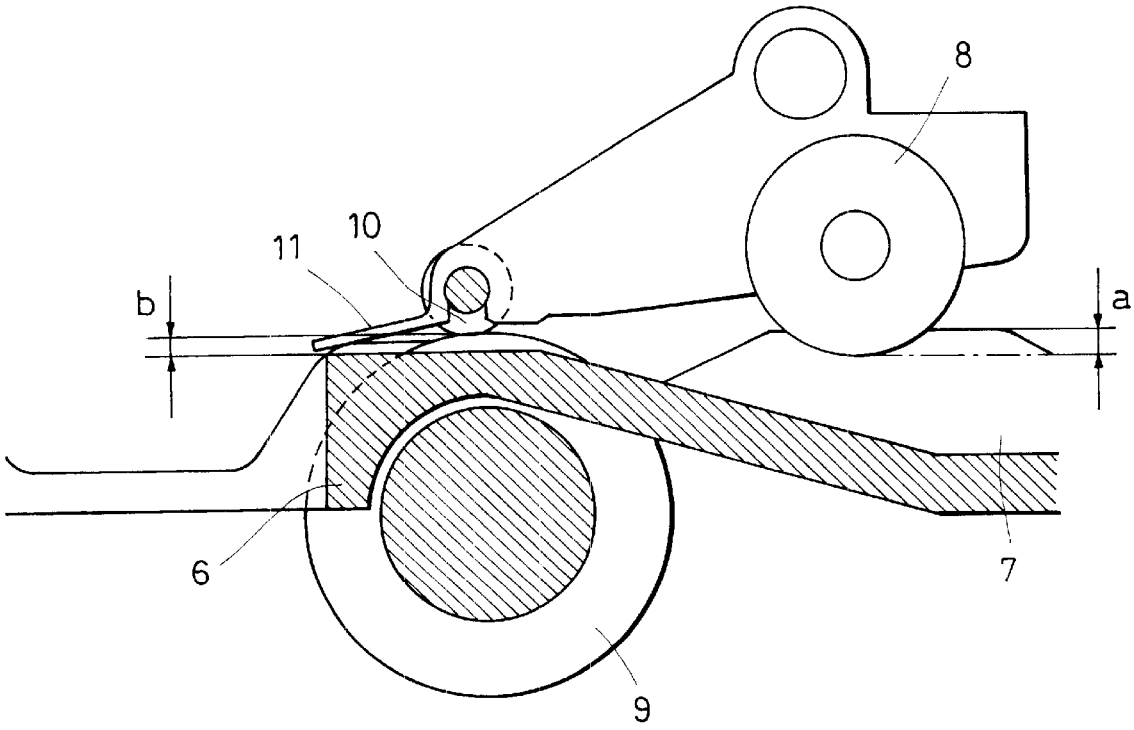
FIG. 2 is a fragmentary sectional view of the ink jet recording apparatus according to the first embodiment.

FIG. 2 is a fragmentary sectional view of the ink jet recording apparatus. It will be seen that the portions of the surface of the platen 6 which guide the left and right end portions of the recording sheet are positioned at a level slightly lower than the level of the top of the transporting roller 9. This arrangement serves to enhance the above-described effect produced by the present invention. It is also possible and effective to reduce the diameter of the transporting roller at both axial end portions that support the left and right end portions of the recording sheet. Such a transporting roller 9 produces the same effect as that produced by the pre-biasing roller 8 that presses and pre-biases the recording sheet before the same is introduced into the nip between the transporting roller 9 and the pinch roller 10. Referring to FIG. 2, the degree of curling or amount of downward bend or curve created by the pre-biasing roller 8 is indicated by "a", while the difference in level between the top of the transporting roller and both lateral end portions of the platen 6 is indicated by "b". Preferably, the amount "a" is greater than the amount "b". The amount "b" of the height difference is preferably small, because a variation of the distance between the ink discharge ports of the recording head and the recording sheet over the entire recording region causes a disturbance in the quality of the recorded image. By way of example, when a recording sheet which is 0.2 mm thick, 100 mm wide, and 150 mm long is used, the amounts "a" and "b" may be respectively set to 1.5 mm and 0.5 mm. Such an arrangement ensures that the recording be performed satisfactorily with a recording sheet of FIG. 4 having a curling amount of up to about 30 mm and a recording sheet of FIG. 5 having a curling amount of up to 20 mm.

Referring again to FIG. 3, the recording region "A" is demarcated by an upstream end line "d" and a downstream end line "e". When it is desired to perform recording on a leading end region of the recording sheet, the recording operation is executed while the recording sheet is so located as to position its leading end edge within the recording region "A". The accuracy of positioning of the leading end edge of the recording sheet relative to the recording region "A" depends on the resolution of detection of the leading end edge. In general, it is possible to position the leading end edge of the recording sheet in the close proximity of the downstream end "e" of the recording region "A" when the recording apparatus has a high resolution of position detection.

Likewise, recording on a trailing end region of the recording sheet is performed while the trailing end edge of the recording sheet is positioned within the recording region "A". It is possible to position the trailing end edge of the recording sheet in close proximity of the upstream end "d" of the recording region "A" when the recording apparatus has a high resolution of position detection.

The ink absorbent 14 exposed upward through the opening 12 in the platen 6 extends in the direction of the main scan performed by the recording head over a distance which is greater than the breadth of the recording sheet. It is therefore possible to effect the recording over the entire area of the recording medium, since the ink directed to an area out of the recording medium is received and absorbed by the ink absorbent, without causing any contamination or other problem.

It will be understood from the foregoing description that the ink jet recording apparatus of the present invention can record information on a region of the recording sheet which is in close proximity of a margin set on the recording sheet. It is to be understood, however, the advantage of the present invention is obtainable even when the recording is performed on a region which is substantially spaced apart from the margin, because the curling pre-bias of the recording sheet effectively prevents problems such as sheet transportation failure.

<Description of Second Embodiment>

Figure 8:
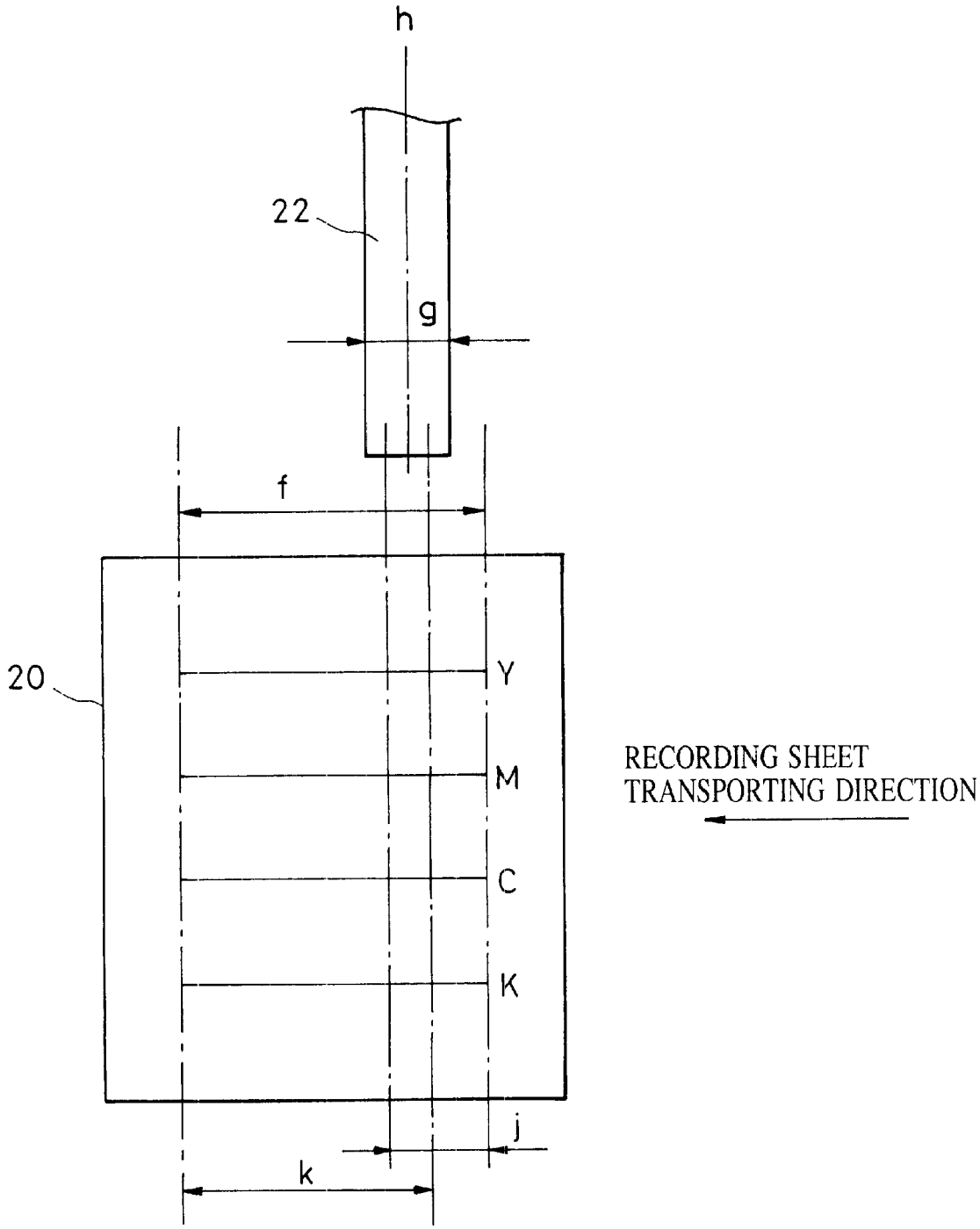
FIG. 8 is an illustration of a second embodiment of the present invention.

A description will now be given of a second embodiment of the present invention, with specific reference to FIG. 8 which shows a positional relationship between the nozzle arrays on the recording head and an aperture 22 formed in the platen. The ink jet recording apparatus of the second embodiment employs a recording head which is the same as the head 20 used in the first embodiment. In the second embodiment, however, the width of the aperture 22 as measured in the direction of movement of the recording sheet is reduced.

The length of each nozzle array on the recording head 20 is indicated by "f", the width of the aperture 22 in the platen as measured in the direction of movement of the recording sheet is indicated by "g", and the center of the aperture 22 is indicated by "h". When it is desired to effect recording on the leading end region of the recording sheet, the recording sheet is stationed such that the leading end edge is aligned with the center line "h" of the aperture 22, and recording is performed by employing only upstream end portions of the nozzle arrays indicated by "j". Likewise, when it is desired to effect recording on the trailing end region of the recording sheet, the recording sheet is stationed such that its trailing end edge is aligned with the center line "h" of the aperture 22, and recording is performed by employing only downstream portions of the nozzle arrays indicated by "k". This recording principle makes it possible to reduce the width of the aperture 22 in the platen for a given length of the nozzle arrays on the recording head 20.

Thus, the second embodiment features the reduced width of the aperture 22 formed in the platen. This serves to suppress release of naps and other matter from the ink absorbent 14. This also serves to suppress contamination of the reverse side of the recording sheet with ink which otherwise tends to occur when downwardly curled leading end of a recording sheet slides along the tapered surfaces of the second guide members into the nip between the sheet ejecting roller and the spur wheel.

<Description of Third Embodiment>

Figure 9:
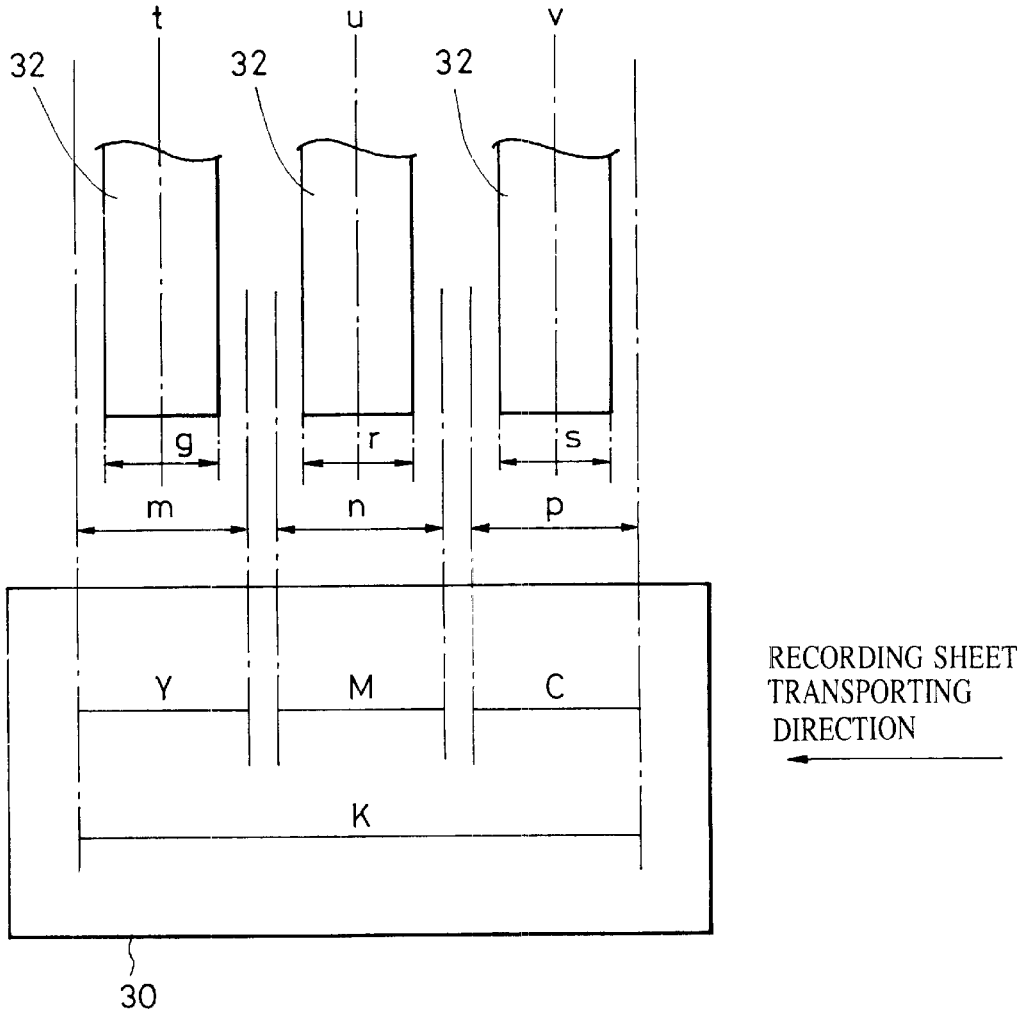
FIG. 9 is an illustration of a third embodiment of the present invention.

A third embodiment of the present invention will be described with reference to FIG. 9 which shows a positional relationship between the nozzle arrays on the recording head and apertures 32 formed in the platen. The third embodiment employs a recording head 30 in which the nozzle arrays Y, M and C for yellow, magenta and cyan colors are arranged in series in the direction of movement of the recording sheet, while a nozzle array K extends in the direction of movement of the recording sheet in parallel with the series of nozzle arrays Y, M and C. The nozzle arrays Y, M and C respectively have lengths "m", "n" and "p". Apertures 32 associated with the nozzle arrays Y, M and C have widths "q", "r" and "s", respectively, as well as centers "t", "u" and "v". For the purpose of effecting recording on a leading end region of the recording sheet, the recording sheet is stationed at a position where the leading end edge thereof is aligned with the center line "v", and recording is effected by the nozzle arrays C and K of the recording head 30. Recording by the nozzle arrays C and K is continued while the recording sheet is further advanced. Then, the recording sheet is stationed at a position where the leading end edge thereof is aligned with the center line "u", and recording is effected by the nozzle arrays M, C and K of the recording head 30. Recording by the nozzle arrays M, C and K is continued while the recording sheet is further advanced. Thereafter, the recording sheet is stationed at a position where the leading end edge thereof is aligned with the center line "t", and recording is effected by the nozzle arrays Y, M, C and K of the recording head 30. Recording by the nozzle arrays Y, M, C and K is continued while the recording sheet is further advanced. Recording on the trailing end region of the recording sheet is conducted in the same way as that for the recording on the leading end region.

It will be understood that the described third embodiment makes it possible to reduce the width of the apertures formed in the platen, even when the recording head used is of the type having nozzle arrays arranged in series in the direction of movement of the recording sheet, without leaving any area which is inaccessible for recording.

<Description of Fourth Embodiment>

Figure 10:
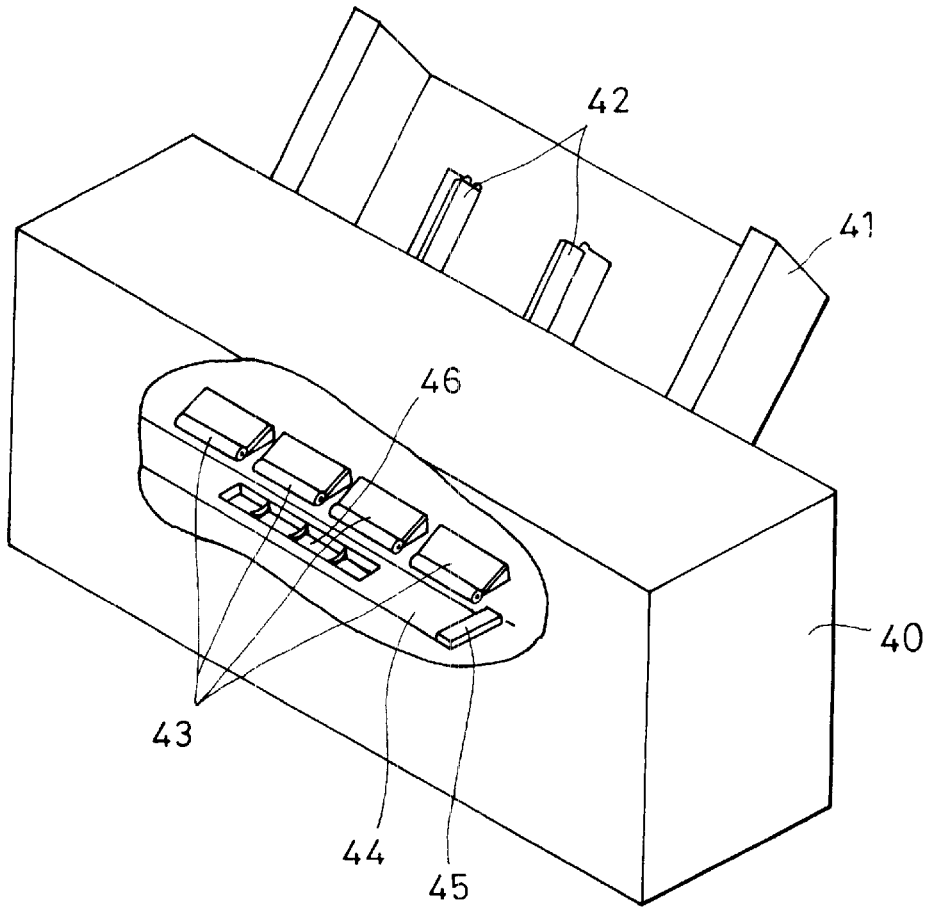
FIG. 10 is a perspective view of an ink jet recording apparatus according to a fourth embodiment of the present invention.
Figure 11:
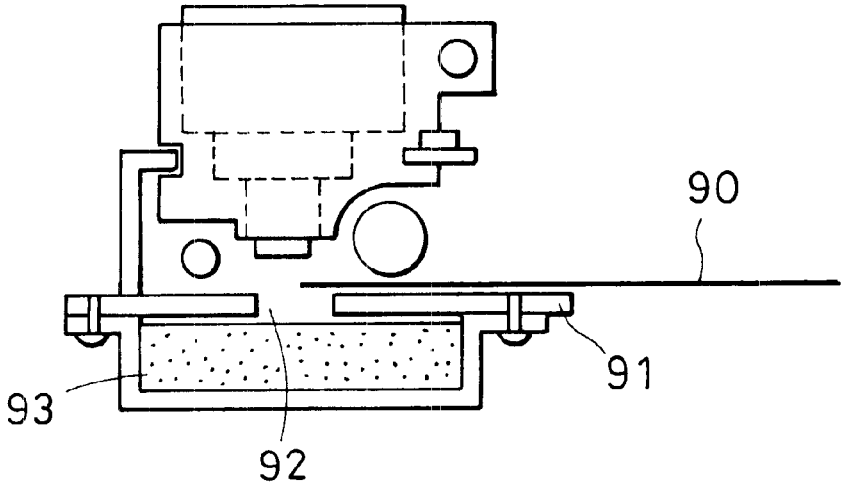
FIG. 11 PRIOR ART
FIG. 11 is an illustration of a conventional ink jet recording apparatus.

FIG. 10 is a perspective view of an ink jet recording apparatus which is a fourth embodiment of the present invention. The fourth embodiment can cope with both a demand for recording on an ordinary plain paper sheet and recording over the entire area of a thick recording sheet.

Referring to this Figure, the ink jet recording apparatus has a main unit 40, a sheet feed unit 41, sheet feed guides 42 provided on the sheet feed unit 41, pinch rollers 43, a platen 44, and a sheet pressing plate 45 provided on the platen 44. An aperture 46 is formed in the platen 44.

When the ink jet recording apparatus is used for recording information on ordinary plain paper sheets, the sheet feed guide 42 is set in the sheet feed unit 41. The recording sheet fed from the sheet feed unit 41 is transported while being pressed at its left end portion by the sheet pressing plate 45, and is forwarded to the recording section and is ejected after the recording.

When the ink jet recording apparatus is used for recording on a thick recording sheet, the sheet feed guides 42 are set upright manually by a user or by means of an actuator which is not shown. The recording sheet is fed from the sheet feed unit 41 to a position where it overlaps the aperture 46 formed in the platen 44 and where the recording is performed. The positional relationship between the recording head and the aperture 46 is the same as that in the second or third embodiments. This ink jet recording apparatus further has the first guide member and a pre-biasing roller which are substantially the same as those used in the first embodiment and which are disposed at positions corresponding to the positions of the sheet feed guides 42.

It will be understood that the ink jet recording apparatus of the fourth embodiment as described is adaptable both to recording on ordinary plain paper sheets and recording on thick recording sheets.

<Other Embodiments and Modifications>

Although the present invention can generally be applied to various types of ink jet recording apparatuses, the advantages offered by the present invention are particularly remarkable when the invention is incorporated in an ink jet recording head or recording apparatus of the type in which energy for discharging ink is derived from means for generating thermal energy, e.g., electro-thermal transducers or a laser beam, the thermal energy causing a change in the state or phase of the recording ink. This is because higher density and higher definition of recording are achievable in such a type of ink jet recording apparatus.

Preferably, such a type of ink jet recording apparatus has configurations and operation principles that are disclosed in, for example, specifications of U.S. Pat. Nos. 4,723,129 and 740,796. Such operation principles and configurations can be applied both to recording apparatuses of a so-called on-demand type and recording apparatuses of so-called continuous type. However, the on-demand type arrangement is particularly useful. In this type of recording apparatus, electro-thermal transducers are arranged so as to correspond to sheets retaining a liquid, e.g., ink or a treated liquid, or to liquid channels, and drive signals or signals corresponding to information to be recorded are supplied to a selected electro-thermal transducer or transducers. Each drive signal has energy large enough to cause such a rapid rise of temperature which in turn causes a film boiling of the liquid on the electro-thermal transducer, skipping over the step of nucleate boiling. Thus, the driving signal or signals cause the electro-thermal transducers to generate thermal energy to effect film boiling of the liquid on the heat-effecting surface of the transducers, with the result a single bubble is formed in the liquid (ink or a treated liquid) corresponding to a single drive signal. The liquid, i.e., ink or a treated liquid, is jetted from a discharge port or nozzle by energy which is produced as a result of expansion and contraction of the bubble, thereby forming at least one droplet. Preferably, the drive signals are supplied in the form of pulses so as to cause instantaneous expansion and contraction of bubbles, thus providing high response speed of ink jetting operation. Pulse signals of the type disclosed in the specifications of U.S. Pat. Nos. 4,463,359 and 4,345,262 can suitably be used as the above-mentioned drive signals. A further superior recording performance is obtainable when specific conditions concerning the rate of temperature rise of the above-mentioned heat-affecting surface are met. Such specific conditions are disclosed in the specification of U.S. Pat. No. 4,313,124.

The present invention does not pose any restriction on the construction of the recording head. For instance, although the specifications of the above-mentioned United States Patents disclose composite arrangements having discharge nozzles, liquid channels and electro-thermal transducers having straight or orthogonal liquid passages, the invention encompasses the use of recording heads in which heat-effecting surfaces are disposed in curved or bent regions, as disclosed in the specifications of the U.S. Pat. Nos. 4,558,333 and 4,459,600. It is also to be appreciated that the present invention can effectively be used in recording apparatuses of the type in which a single slit serves as a discharge opening which is common to a plurality of electro-thermal transducer elements as disclosed in Japanese Patent Laid-Open No. 59-123670, or in recording apparatuses of the type which has an aperture or perforation associated with each discharge opening and intended to absorb pressure impulse of liquid caused by thermal energy. Thus, the present invention ensures that recording be performed satisfactorily and efficiently regardless of the type of the recording head used in the recording apparatus.

Furthermore, the present invention can be embodied also with the use of a full-line-type recording head that has a length corresponding to the width of the widest available recording medium. Such a recording head may be implemented by connecting a plurality of modules of recording heads to achieve the desired length, or may be formed as a single unitary recording head.

It is also to be understood that various types of serial-type recording apparatuses can effectively incorporate the present invention. For instance, the present invention can effectively be carried out in the form of a recording apparatus having a recording head fixed to the main unit of the apparatus, a chip-type recording head which is detachably mounted on the main unit with electrical connection to the main unit and with fluid communication for the supply of ink from the main unit, or a cartridge-type recording head in which an ink tank is constructed integrally with the recording head.

The ink jet recording apparatus of the present invention preferably has a discharge recovery means for recovering safe discharging condition of the recording head or other preparatory or auxiliary means, because provisions of such means serves to further ensure the advantages of the present invention. Such recovery means and the preparatory or auxiliary means may include, for example, capping means for capping the nozzle openings of the recording head, cleaning means, pressurizing or suction means, electro-thermal transducers or other heat-generating elements, pre-heating means that combines such means, or a preparatory discharging means that performs preparatory discharging other than for recording.

Further, the present invention does not restrict the type and number of the recording head or recording heads used in the recording apparatus. For instance, the recording apparatus in accordance with the present invention may employ only one recording head for single color recording, or a plurality of recording heads intended to perform recording in different colors and/or at different densities. More specifically, the present invention can effectively be carried out to implement a variety of recording modes. Thus, the present invention can effectively be incorporated in recording apparatuses of the type which has, in addition to a single-color recording mode using a single principal color such as black, at least one of a multi-color recording mode employing different colors and a full-color recording mode which effects full-color recording my mixing different colors of inks. Such multi-color recording mode and full-color recording mode can be realized by using an integral recording head having nozzles allocated to different colors, or by a composite recording head composed of a plurality of module recording heads used for different colors.

The foregoing description of the embodiments and modifications is based on an assumption that the ink used in the recording apparatus is a liquid. The ink, however, may be of the type which is solidified at room temperature or below and softened or liquefied at a temperature higher than room temperature. The ink-jet recording technique usually controls the temperature of the ink so that the ink exhibits a viscosity suitable for jetting, e.g., to a temperature not lower than 30° C. but not higher than 70° C. Thus, the recording apparatus in accordance with the present invention may have a function to liquefy the ink by energy supplied concurrently with the recording signal. It is also possible to use ink of the type which remains in solid state when shelved but is liquefied when heated. Such ink does not show any temperature rise because the heat energy supplied thereto is consumed as latent heat that causes a change of the state of the ink from solid to liquid. Such ink also is free from wasteful consumption due to evaporation, because it is held in solid state when left without being used. The present invention also can be carried out with the use of ink that is liquefied only when thermal energy is imparted thereto, such as ink of the type which is liquefied by application of thermal energy accompanying the recording signals and then jetted while it is in its liquid phase, or ink of the type which starts to solidify before or upon arriving at the recording medium. As disclosed in Japanese Patent Laid-Open Nos. 54-56847 and 60-71260, such type of ink in liquid or solid state may be retained in pores or through-holes in a porous sheet so as to oppose electro-thermal transducers. The present invention can most effectively be carried out by using an ink discharge system that relies upon the aforesaid film boiling of each type of ink described heretofore.

It is also to be appreciated that the ink jet recording apparatus of the present invention may be used as an image outputting terminal for an information processing apparatus such as a computer, or may be combined with an image reader to serve as a copying apparatus. The ink jet recording apparatus of the invention also may have a signal transmitting/receiving function to implement a facsimile apparatus.

As will be understood from the foregoing description, the present invention provides an ink jet recording apparatus having a transporting roller for transporting a recording medium to a recording section, and a pre-biasing member disposed upstream of the transporting roller and arranged to impart to the recording medium a curling tendency suitable for the recording. By virtue of these features, the present invention makes it possible to record an image in a region that just falls within predetermined margins of the recording medium, even when the image requires deposition of a large quantity of ink per unit area.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus having recording means for effecting recording on a recording medium at a recording zone, said recording apparatus comprising:

a transporting roller for transporting the recording medium to the recording zone;

a pre-biasing roller disposed upstream of said transporting roller and arranged to impart to the recording medium a curling tendency enabling recording to be performed; and a guide member disposed to face said pre-biasing roller and interacting with said pre-biasing roller to impart the curling tendency to the recording medium.

2. A recording apparatus according to claim 1, wherein the curling tendency imparted to the recording medium enables the recording medium to move smoothly through the recording zone.

3. A recording apparatus according to claim 1, wherein said pre-biasing roller is spool-shaped.

4. A recording apparatus according to claim 1, further comprising a platen facing and cooperating with said transporting roller to impart a further curling tendency to the recording medium.

5. A recording apparatus according to claim 4, wherein a degree of curling imparted to the recording medium is defined by a distance an edge of the recording medium is deflected beyond a plane defined at the center of the recording medium, and the degree of curling imparted by said platen on the recording medium is less than the degree of curling imparted by said pre-biasing roller on the recording medium.

6. A recording apparatus according to claim 1, wherein said recording means comprises ink jet recording means for discharging ink onto the recording medium at the recording zone.

7. A recording apparatus having recording means for effecting recording on a recording medium at a recording zone, said recording apparatus comprising:

a transporting roller for transporting the recording medium to the recording zone;

a pre-biasing roller disposed upstream of said transporting roller relative to the transporting direction of the recording medium and arranged to provide the recording medium with a tendency such that left and right end portions of the recording medium are biased away from the recording means; and a guide member disposed to face said pre-biasing roller and interacting with said pre-biasing roller to impart the curling tendency to the recording medium.

8. A recording apparatus according to claim 7, wherein the curling tendency imparted to the recording medium enables the recording medium to move smoothly through the recording zone.

9. A recording apparatus according to claim 7, wherein said pre-biasing roller is spool-shaped.

10. A recording apparatus according to claim 7, further comprising a platen facing and cooperating with said transporting roller to impart a further curling tendency to the recording medium.

11. A recording apparatus according to claim 10, wherein a degree of curling imparted to the recording medium is defined by a distance an edge of the recording medium is deflected beyond a plane defined at the center of the recording medium, and the degree of curling imparted by said platen on the recording medium is less than the degree of curling imparted by said pre-biasing roller on the recording medium.

12. A recording apparatus according to claim 7, wherein said recording means comprises ink jet recording means for discharging ink onto the recording medium at the recording zone.

13. A recording apparatus having recording means for effecting recording on a recording medium at a recording zone, said recording apparatus comprising:

a transporting roller for transporting the recording medium to the recording zone;

a pre-biasing roller disposed upstream of said transporting roller relative to the transporting direction of the recording medium and arranged to provide the recording medium with a tendency such that left and right end portions of the recording medium are biased away from the recording means;

a platen having a guiding surface for guiding and supporting the recording medium in the recording zone;

an aperture formed in said platen and extending in a width direction of the recording medium and having a predetermined width, said aperture being disposed so as to oppose the recording means;

a sloping surface disposed in said aperture and extending downstream relative to the transporting direction of the recording medium; and a guide member disposed to face said pre-biasing roller and interacting with said pre-biasing roller to impart the curling tendency to the recording medium.

14. A recording apparatus according to claim 13, wherein the curling tendency imparted to the recording medium enables the recording medium to move smoothly through the recording zone.

15. A recording apparatus according to claim 13, wherein said pre-biasing roller is spool-shaped.

16. A recording apparatus according to claim 13, further comprising a platen facing and cooperating with said transporting roller to impart a further curling tendency to the recording medium.

17. A recording apparatus according to claim 16, wherein a degree of curling imparted to the recording medium is defined by a distance an edge of the recording medium is deflected beyond a plane defined at the center of the recording medium, and the degree of curling imparted by said platen on the recording medium is less than the degree of curling imparted by said pre-biasing roller on the recording medium.

18. A recording apparatus according to claim 13, wherein said recording means comprises ink jet recording means for discharging ink onto the recording medium at the recording zone.

19. A recording apparatus according to claim 18, wherein the width of said aperture is smaller than a scanning length of the recording means.

20. A recording apparatus according to claim 18, further comprising an ink absorbent disposed so as to be exposed through said aperture.

21. A recording apparatus according to claim 18, wherein said ink jet recording means discharges at least one ink droplet produced by thermal energy, thereby performing recording.

22. A recording apparatus according to claim 18, wherein said recording means comprises at least two arrays of nozzles aligned in the transporting direction and at least two apertures are formed in said platen.

23. A recording apparatus according to claim 18, wherein said recording means comprises more than one array of nozzles aligned in a direction transverse to the transporting direction and one said aperture is formed in said platen.

24. A recording apparatus according to claim 18, wherein said recording means comprises nozzles extending along the width of the recording zone in the transporting direction, and when the leading end of the recording medium enters the recording zone, only a portion of the nozzles on the upstream side of the recording head are used.

25. A recording apparatus according to claim 18, wherein said recording means comprises nozzles extending along the width of the recording zone in the transporting direction, and when the trailing end of the recording medium leaves the recording zone, only a portion of the nozzles on the upstream side of the recording head are used.

26. A recording apparatus according to claim 13, wherein said aperture is wider than the recording zone in the transporting direction.

27. A recording apparatus according to claim 13, wherein a width of said aperture is less than a width of the recording zone in the transporting direction.

28. A recording apparatus according to claim 27, wherein said aperture is provided near an upstream side of the recording zone relative to the transporting direction.

29. A recording apparatus according to claim 13, wherein said sloping surface comprises a plurality of ribs extending in the transporting direction with spaces disposed between said ribs.

30. A recording apparatus according to claim 29, wherein a width of each of said ribs is substantially less than a distance between each rib.

* * * * *